US007028738B2

(12) United States Patent
Ceccofiglio

(10) Patent No.: US 7,028,738 B2
(45) Date of Patent: Apr. 18, 2006

(54) SHUTTER SYSTEM AND BARRIER ASSEMBLY FOR USE IN CONNECTION THEREWITH

(76) Inventor: David H. Ceccofiglio, 2200 NE. 62nd Ct., Fort Lauderdale, FL (US) 33308

( * ) Notice: Subject to any disclaimer, the term of this patent is extended or adjusted under 35 U.S.C. 154(b) by 234 days.

(21) Appl. No.: 10/672,797

(22) Filed: Sep. 26, 2003

(65) Prior Publication Data

US 2005/0067116 A1 Mar. 31, 2005

(51) Int. Cl.
*E06B 9/08* (2006.01)

(52) U.S. Cl. ..... 160/133; 160/273.1

(58) Field of Classification Search ..... 160/133, 160/351, 273.1, 232, 236, 201, 290.1, 41, 160/272, 271
See application file for complete search history.

(56) References Cited

U.S. PATENT DOCUMENTS 3,643,529 A * 2/1972 Bright ..... 16/96 R
4,586,552 A 5/1986 Labelle
4,601,320 A 7/1986 Taylor
5,253,694 A * 10/1993 Bernardo ..... 160/133
5,657,805 A * 8/1997 Magro ..... 160/133
5,839,493 A * 11/1998 Quasius ..... 160/133
6,021,837 A 2/2000 Miller
6,065,525 A * 5/2000 Wells ..... 160/273.1
6,068,040 A * 5/2000 Magro et al. ..... 160/133
6,394,173 B1 * 5/2002 Enssle ..... 160/273.1

FOREIGN PATENT DOCUMENTS

DE 2709029 A1 9/1978

* cited by examiner

*Primary Examiner*—David Purol
(74) *Attorney, Agent, or Firm*—Kevin P. Crosby, Esq.; Daniel C. Crilly, Esq.; Brinkley, McNerney et al.

(57) ABSTRACT

A shutter system for covering a wall opening includes a mounting assembly and a retractable/deployable barrier assembly. The mounting assembly includes at least one pair of guide tracks that are mountable on opposing sides of the opening. Each guide track includes inner surfaces that define a guide channel. Two of the inner surfaces oppose one another and at least one of such surfaces includes a protruding member that extends into the guide channel and angles away from an open end thereof. The barrier assembly includes a series of interlocking slats, some or all of which define angled recesses constructed to accommodate unobstructed passage of the slats in the guide channel during deployment and retraction. The recesses in the slats are further constructed to enable the slats to engage the protruding members of the guide tracks in the event that the slats are deflected due to exertion of a displacement force.

17 Claims, 3 Drawing Sheets

SHUTTER SYSTEM AND BARRIER ASSEMBLY FOR USE IN CONNECTION THEREWITH

FIELD OF THE INVENTION

The present invention relates generally to shutter systems for covering openings in walls of buildings and, more particularly, to a retractable/deployable shutter system and barrier assembly for use in connection therewith that utilize interlocking slats having recesses to assist in retaining the slats in associated guide rails when displacement forces are exerted upon the slats.

BACKGROUND OF THE INVENTION

Shutter systems are well known. Such systems are typically used on an s-needed basis to cover and protect windows, doors, and other openings in buildings from flying debris and other displacement forces that result from strong storms, such as severe thunderstorms, hurricanes, tropical storms, typhoons, and tropical cyclones. Such systems may also be used on a more regular basis (e.g., daily) to provide privacy, noise reduction, and security or intrusion resistance.

Basic shutter systems include a barrier assembly made up of corrugated steel or aluminum alloy panels that are fastened over the wall openings using threaded bolts that screw into anchors recessed in the walls of the building. Other basic systems also use corrugated panels, but instead of recessed anchors, such systems use rails that are secured to the building above and below the opening. The panels are inserted along the rails and are secured to the rails with bolts and wing nuts.

While storm panels are useful in protecting the building's openings, they have certain disadvantages. For example, steel panels are relatively heavy, weighing approximately two pounds per square foot. Thus, such panels become difficult to install on a two or three story dwelling, particularly when the homeowner must carry each panel necessary to cover the upper story windows up a ladder and onto a roof. Making the upper story installation even more difficult is the common use of wavy, Spanish tile roofs on many homes in geographical areas that are more prone to be in the paths of hurricanes or other strong storms.

Other more sophisticated storm shutter systems are also commercially available. One such system is referred to as an accordion shutter system. In an accordion shutter system, rails are installed above and below the wall opening, and a flexible, corrugated panel is permanently installed just outside each vertical end of the opening such that the panels, when deployed, can slide in the track created by the rails. When not in use, the panels are in a collapsed or compressed state and reside adjacent the vertical ends of the opening. To use, the user manually pulls or deploys each panel toward the center of the opening and locks the two panels together with a small padlock or other locking mechanism to keep them in place. When the storm has passed or use is otherwise no longer necessary or desired, the lock is removed and the user manually pushes or retracts the panels into their collapsed positions adjacent the vertical ends of the opening. Since the accordion panels are permanently installed, they need not be physically carried to and from their intended location before and after use.

Another more sophisticated shutter system is commonly referred to as a roller system or a rolling shutter system. In this system, the panels and anchors or rails of basic and accordion systems are replaced with a different barrier assembly made up of a series of interlocking steel or aluminum alloy slats that are wound around a motorized roller tube or reel. The roller tube resides in a housing that is mounted to the building just above the opening to be protected. Guide tracks are also mounted on each vertical end of the opening to guide the movement of the slats during deployment and retraction.

The motor of the rolling shutter system is electrically controlled and deploys the slats to cover the building's opening upon activation thereof. The deployment or lowering of the rolling shutter is based on the free fall of the interlocked slats primarily from the force of gravity while the roller tube rotates in one direction. Subsequent activation of the motor causes the motor to rotate the roller tube in an opposite direction to retract the slats and restore them on the roller tube. A motorized roller and its associated housing are permanently installed above every opening to be covered by the system. Dependable operation of the rolling shutter system relies on the ability of the slats to freely travel in the guide tracks without obstruction from pins, stems, or any other integrated components of the tracks.

While rolling shutter systems are very convenient forms of storm protection and security, they have their limitations. For example, the exertion of sufficiently strong displacement forces against the slats can cause the slats to deflect or bow excessively and thereby dislodge from the guide tracks, exposing the wall opening to flying debris or an intruder.

Various approaches have been proposed in order to try to prevent such dislodgement of the slats. One such approach is disclosed in U.S. Pat. No. 5,839,493 issued to Quasius. Quasius describes a rolling shutter and retention assembly in which stop elements are inserted into the ends of the shutter slats and the guide tracks include angled retention surfaces. When the slats are bowed as a result of displacement forces, the stop elements (e.g., screws or nails) engage the retention surfaces of the guide tracks to prevent or substantially impede dislodgement of the slats. While the Quasius system provides a mechanism for reducing the likelihood of slat dislodgement during application of displacement forces, the Quasius system requires stop elements to be inserted into the ends of the slats during fabrication of the shutter system, thereby increasing the overall cost and complexity of the system. In addition, the stop elements of the Quasius system are made of steel and, therefore, do not recover from bending that may result from the application of strong displacement forces against the slats. The stop elements' failure to recover from bending could produce an obstruction in the guide tracks, thereby negatively impacting the movement of the slats during subsequent operation of the system. To avoid such obstruction, the stop elements may require replacement, which, if not performed properly, could reduce the usefulness of the system.

Another slat dislodgement prevention approach is disclosed in German Patent Application Publication No. DE 2709029A1. Such publication describes a roller shutter that includes a guide track having one or more stems extending perpendicularly from respective shanks of the track. The slats of the shutter system have matching recesses to accommodate the extending stem(s), while leaving room for play. While the system described in the German publication provides a mechanism for reducing the likelihood of slat dislodgement without the need for stop ends to be inserted in the slats, such system requires the slats to operate integrally with the perpendicularly oriented guide rail stem. However, the guide rail may not be perfectly vertical due to normal architectural tolerances in the building to which the guide rail is attached. As a result, the guide rail stem may slightly obstruct the deployment of the slats, particularly when the shutter system is used on a daily basis for, for example, security and privacy reasons.

Therefore, a need exists for a shutter system and barrier assembly for use in connection therewith that substantially reduces the likelihood of slat dislodgement in the presence of severe displacement forces without requiring stop ends to be inserted into the ends of the slats and without requiring integral operation of guide track stems and slat recesses.

DETAILED DESCRIPTION OF PREFERRED EMBODIMENTS

Generally, the present invention encompasses a shutter system and barrier assembly for use in connection therewith for covering an opening in wall of a building. The shutter system includes a mounting assembly and a retractable/deployable barrier assembly. The mounting assembly includes at least one pair of guide tracks that are mountable to the wall of the building on opposing sides of the opening. Each guide track includes inner surfaces that define a guide channel. Two of the track's inner surfaces oppose one another and at least one of the two, opposing inner surfaces includes one or more protruding members that extend into the guide channel and angle away from an open end of the guide channel. The barrier assembly includes a series of interlocking slats, each of which defines one or more angled recesses constructed to accommodate unobstructed passage of the slat in the guide track(s) during deployment and retraction of the barrier assembly. The recesses in the slats are further constructed such that the slats engage the protruding members of the guide track in the event that the slats are deflected or bowed due to exertion of a displacement force against the barrier assembly, thereby retaining the slats in the guide track under such conditions.

By providing a shutter system and barrier assembly in this manner, the present invention reduces the likelihood of barrier assembly slat dislodgement in the presence of strong displacement forces, such as wind forces and projectile impact forces that result from strong tropical storms, typhoons or hurricanes, without requiring the fabrication and maintenance complexities of adding stop members to the ends of the slats as in the prior art. With the present invention, fabrication of the slats and the guide tracks can proceed using conventional fabrication processes. For example, the guide tracks and slats of the present invention, including their respectively angled protruding members and accommodating recesses, may be fabricated using the same extrusion processes that are used to make existing guide tracks and slats, albeit with different dies. In addition, the present invention provides a slat dislodgement protection mechanism that is much less likely to result in obstruction of the slats during their deployment than are prior art systems that include guide tracks having perpendicularly-protruding stems that pass through accommodating recesses in the slats.

Figure 1:
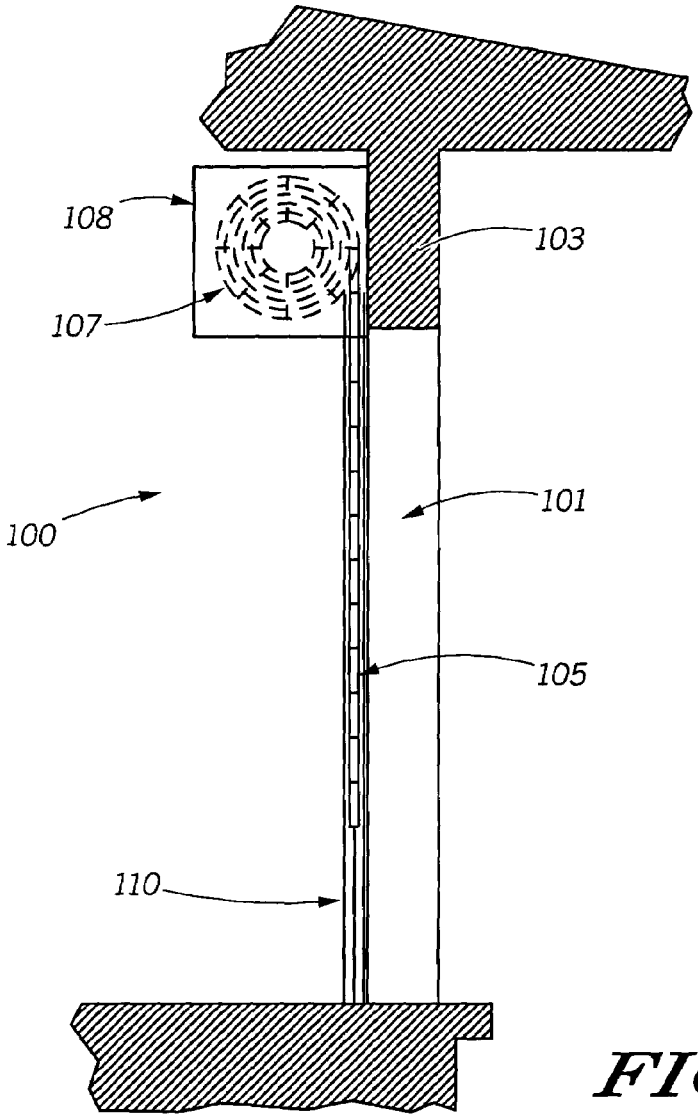
FIG. 1 is a cut-away side view of an installed shutter system in a deployed configuration to cover an opening in a building in accordance with a preferred embodiment of the present invention.

The present invention can be more fully understood with reference to FIGS. 1–5, in which like reference numerals designate like items. FIG. 1 is a cut-away side view of an installed shutter system 100 in a deployed configuration to cover an opening 101 in a building in accordance with a preferred embodiment of the present invention. The depicted shutter system 100 includes a retractable and deployable barrier assembly, a mounting assembly, and a motorized roller 107 (shown in phantom in FIG. 1) and housing 108. The barrier assembly preferably includes a series of interlocking horizontal slats 105 that deploy from and retract into, as applicable, the roller 107 and/or its associated housing 108. When deployed, the slats 105 cover the opening 101 in the wall 103 of the building such that the inside surfaces of the slats 105, which together define an inside surface of the barrier assembly, are proximate the opening 101 and the outside surfaces of the slats 105, which together define an outside surface of the barrier assembly, are positioned to receive any externally-generated displacement forces that may be exerted against the barrier assembly. The motorized roller 107 is constructed in accordance with conventional techniques to retain the slats 105 in a rolled configuration until deployment is desired and to deploy the slats 105 upon activation by a user such that the slats 105 cover the opening 101 in the wall 103 to which the motor housing 108 is mounted.

Each of the slats 105 is preferably fabricated in a conventional manner from high strength aluminum alloy (e.g., 6063-T5 or 6063-T6 extruded aluminum alloy manufactured by Aluminio Dominicano of Santo Domingo, Dominican Republic or various other manufacturers), steel, high strength plexiglass, or any other material capable of withstanding a desired level of displacement forces (e.g., those associated with wind speeds up to approximately 155 miles per hour). When deployed, the series of slats 105 have a periphery larger than the wall opening 101 that the slats 105 are intended to shield to prevent, or at least substantially impede, any projectiles or other displacement forces from entering the opening 101.

The mounting assembly preferably comprises at least one pair of guide tracks 110 that are mountable to opposing sides of the wall opening 101. Each guide track 110 is preferably fabricated from high strength aluminum alloy (e.g., 6063-T5 or 6063-T6 extruded aluminum alloy) using conventional extrusion processes. During installation, each guide track 110 is mounted to the wall 103 using appropriate conventional fasteners (e.g., TAPCON concrete screws when the guide tracks 110 are secured to a concrete block wall 103). The guide tracks 110 and the slats 105 of the shutter system 100 are described in more detail with respect to FIGS. 2–5.

Figure 2:
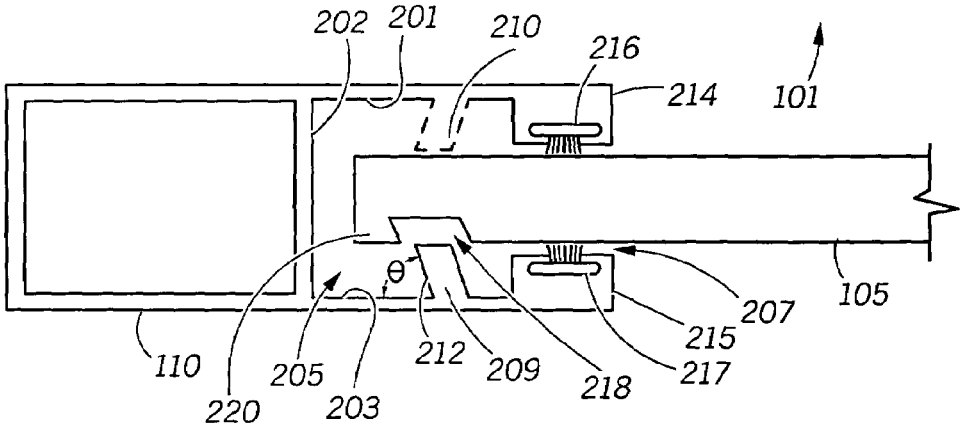
FIG. 2 is a partial detailed cross-sectional top view of a guide track and a slat of a barrier assembly in accordance with a preferred embodiment of the present invention.

FIG. 2 is a partial detailed cross-sectional top view of a guide track 110 and a slat 105 of the shutter system 100 of FIG. 1 in accordance with a preferred embodiment of the present invention. As shown, the guide track 110 includes three inner surfaces 201–203 that together define a guide channel 205 of the track 110. Two of the three inner surfaces (e.g., surfaces 201 and 203) preferably oppose one another as shown. With such construction, the guide channel 205 has an open end 207 that permits the slat 110 to extend out of the track 110 and across the wall opening 101. Thus, the guide track 110 functions to maintain the slats 105 of the barrier assembly in a desired position relative to the wall opening 101.

In addition to assisting in defining the guide track's guide channel 205, one or both opposing inner surfaces 201, 203 of the guide track 110 include one or more angled protruding members 209, 210 (two shown, although member 210 is shown in phantom to indicate that it is an optional feature). Each angled protruding member 209 extends into the guide channel 205 and angles away from the guide channel's open end 207. The angle at which the protruding member 209 extends into the track's guide channel 205 may be any angle in the range of about 30 degrees to about 89 degrees, but preferably comprises an angle in the range of about 45 degrees to about 75 degrees. The angle at which the protruding member 209 extends into the guide channel 205 is preferably determined by measuring the angle (θ) formed between the inner surface 203 of the guide track 110 from which the protruding member 209 extends and an inner, angled surface 212 of the protruding member 209.

The amount that the protruding member 209 extends into the guide track's channel 205 depends on a variety of factors, including, without limitation, the thickness of the slats 105, the location of the member 209 in the channel 205, the amount of slat deflection permitted prior to engagement by the member 209, and tolerances of the slat thickness, channel width, and building height. In a preferred embodiment, the protruding member 209 has a length in the range of approximately ¼ inches to ½ inches (approximately 6.35 millimeters to 12.7 millimeters) and extends into the guide track channel 205 in the range of approximately 3/16 inches to 7/16 inches (approximately 4.7 millimeters to approximately 11.2 millimeters).

The guide track 110 also preferably includes a pair of guide rails 214, 215 and a pair of rubber pads 216, 217 that are inserted into corresponding channels in the guide rails 214, 215. The guide rails 214, 215 extend into the guide channel 205 and along a length of the guide track 110. The guide rails 214, 215 are disposed on the two, opposing inner surfaces 201, 203 of the guide track 110 proximate the open end 207 of the guide channel 205. The guide rails 214, 215 are preferably fabricated together with the other metal components of the guide track 110 using a conventional extrusion process. The rubber pads 216, 27 are fabricated in an elongated form in accordance with known techniques to fit as inserts in the matching channels of the guide rails 214, 215. The guide rails 214, 215 and their associated rubber pads 216, 217 serve to control the movement of the slats 105 in the guide track 110. In addition, as described in more detail below with respect to FIG. 5, the guide rails 214, 215 may further assist in retaining the slat 105 in the guide track 110 in the event that the slat 105 is deflected due to exertion of a displacement force against the barrier assembly.

As also shown in FIG. 2, each slat 105 of the shutter system's barrier assembly defines at least one angled recess 218 (one shown) that is constructed to accommodate unobstructed passage of the slat 105 in the guide track 110 (e.g., over or above (or under or below, as applicable) the protruding member(s) 209, 210 of the guide track 110) during deployment and retraction of the barrier assembly. Inclusion of such a recess 218 or recesses in the slat 105 creates a lip 220 at the horizontal end of the slat 105. When the slat 105 is operatively positioned in the guide track 110 and a sufficient displacement force is exerted against the slat 105, the lip 220 of the slat 105 translates toward the open end 207 of the guide track 110 and cooperates with the guide track's protruding member 209 to retain the slat 105 in the guide track 110. On the other hand, when displacement forces are not present, the protruding member 209 of the guide track 110 and the recess 218 in the slat 105 do not cooperate or operate integrally, thereby permitting unobstructed passage of the slat 105 in the guide track 110.

Figure 3:
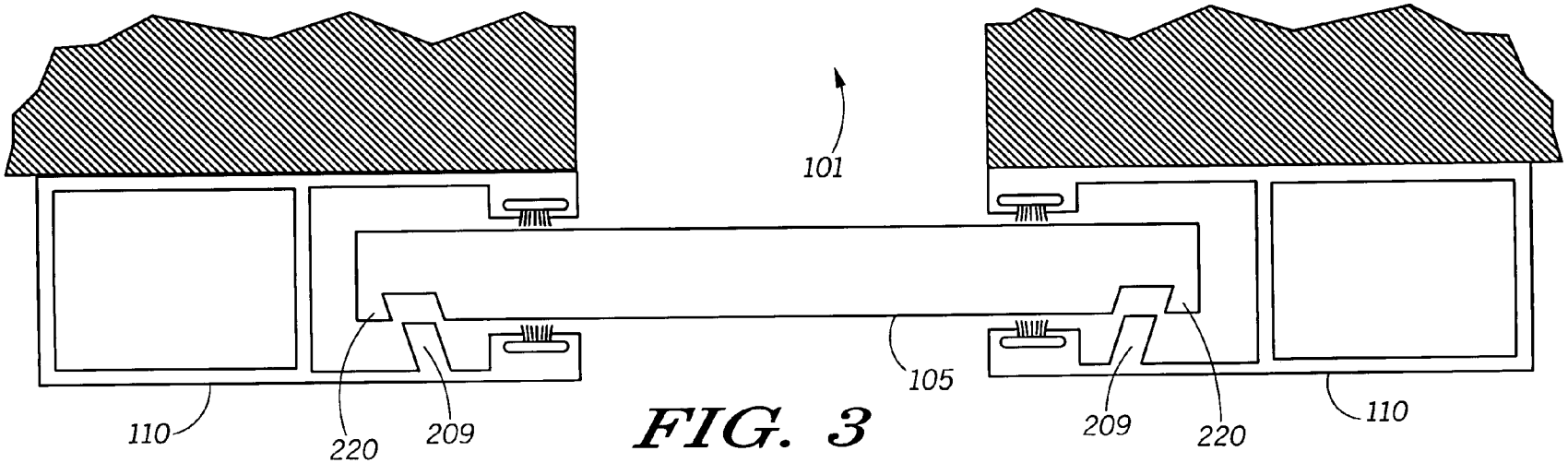
FIG. 3 is a cross-sectional top view of the mounting assembly and the barrier assembly of the shutter system of FIG. 1 with the slats of the barrier assembly in a normal position.
Figure 4:
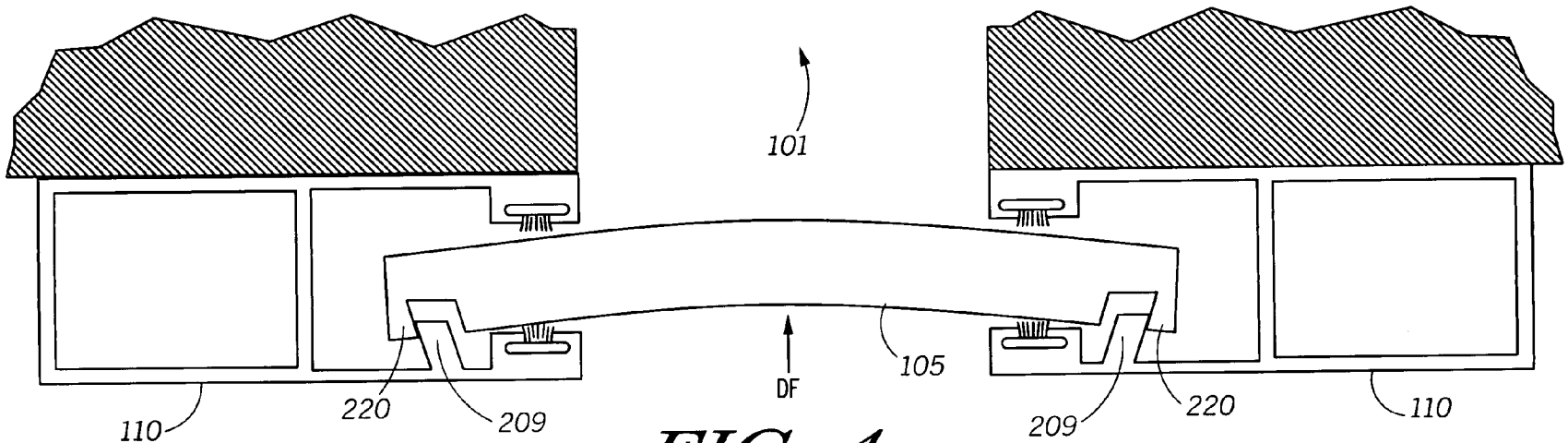
FIG. 4 is a cross-sectional top view of the mounting assembly and the barrier assembly of the shutter system of FIG. 1 with the slats of the barrier assembly deflected in response to exertion of a displacement force.

As illustrated in FIGS. 3 and 4, respectively, the slats 110 of the barrier assembly are capable of moving or flexing between a generally flat position as shown in FIG. 3 and a deflected or bowed position as shown in FIG. 4 when a displacement force (DF) is exerted against the barrier assembly (e.g., in the direction of the wall opening 101 as shown). When displacement forces, such as forces associated with attempted forced entry into the building, wind forces, or projectile impact forces associated with a hurricane, tropical storm, tropical cyclone, or typhoon, are exerted upon the slats 105 of the barrier assembly, the slats 105 deflect as shown in FIG. 4 such that the lips 220 or end portions of the slats 105 translate toward the guide channel opening 207. Once the lips 220 of the slats 105 translate far enough, the lips 220 engage the protruding members 209 of the guide tracks 110 to secure and retain the slats 105 within the guide tracks 110. In an alternative embodiment in which the guide tracks 110 include optional protruding members 210 and the slats 105 include matching recesses (not shown), engagement of the protruding members 210 with the matching recesses resulting from exertion of a displacement force directed outwardly from the wall opening 101 secures and retains the slats 105 within the guide tracks 110.

Figure 5:
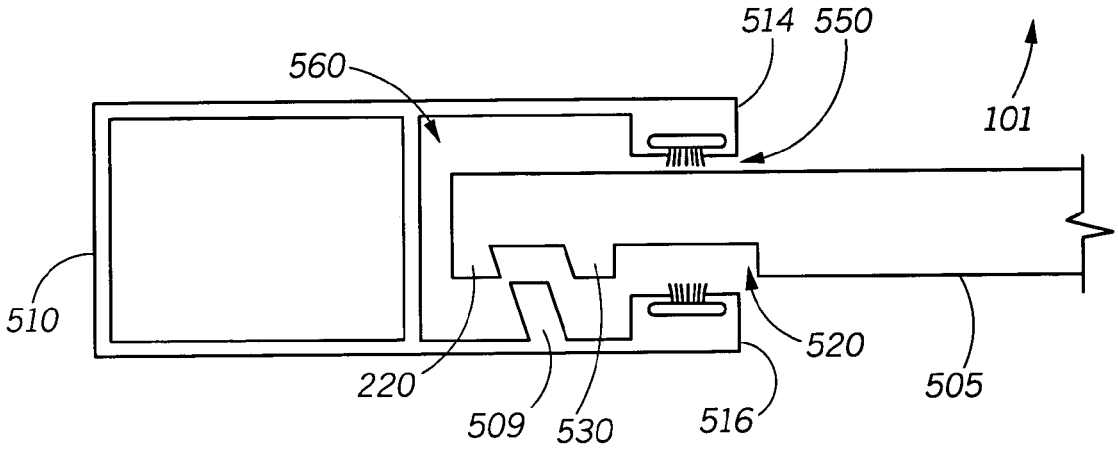
FIG. 5 is a partial detailed cross-sectional top view of a guide track and a slat of a barrier assembly in accordance with an alternative embodiment of the present invention.

FIG. 5 is a partial detailed cross-sectional top view of a guide track 510 and a slat 505 of a barrier assembly in accordance with an alternative embodiment of the present invention. The guide track 510 and slat 505 depicted in FIG. 5 are identical to those depicted in FIG. 2, except that the slat 505 in FIG. 5 includes an additional recess 520 that corresponds to the guide track protrusion formed by one of the guide rails 514, 516. The additional recess 520 in the slat 505 creates an intermediate portion 530 of the slat 505. As a result, in this embodiment, when a displacement force is exerted against the slat 505 in the direction of the wall opening 101, the intermediate portion 530 of the slat 505 displaces or translates toward the opening 550 in the guide channel 560 and engages the guide rail 516 to further assist in retaining the slat 505 in the guide track 510. Thus, in the embodiment depicted in FIG. 5, two protruding members 509, 516 of the guide track 510, one angled into the guide channel 560 away from the channel opening 550 and the other perpendicular to the guide channel 560 and proximate the channel opening 550, engage separate portions of the slat 505 to retain the slat 505 in the guide track 510 in the presence of displacement forces.

As described above, the present invention encompasses a shutter system and associated barrier assembly for use in protecting building wall openings from damage resulting from exertion of large displacement forces, such as wind forces exerted during thunderstorms, tropical storms, hurricanes, tornados or other events. The shutter system and barrier assembly of the present invention reduce the likelihood that strong displacement forces exerted against the slats of the barrier assembly will dislodge the slats from the mounting assembly, without requiring the fabrication complexities of some prior art slat dislodgement mitigation solutions. With the present invention, fabrication of slats of the barrier assembly and guide tracks of the shutter system's mounting assembly can proceed using conventional fabrication processes. In addition, by incorporating angled guide track protrusions and matching slat recesses, the present invention provides slat dislodgement protection while mitigating the likelihood of slat obstruction during deployment and retraction of the slats.

In the foregoing specification, the present invention has been described with reference to specific embodiments. However, one of ordinary skill in the art will appreciate that various modifications and changes may be made without departing from the spirit and scope of the present invention as set forth in the appended claims. For example, various combinations of guide track protrusions and corresponding slat recesses can be utilized to further reduce the likelihood of slat dislodgement resulting from exerted displacement forces. For instance, the guide track may be fabricated to include multiple angled protruding members and the slats may be fabricated to include multiple corresponding slat recesses to achieve a desired reduction in the likelihood of slat dislodgement. In addition, when the slats 505 include recesses that correspond with the guide rails 516 of the guide tracks 510, such recesses may be incorporated in only some, but not all, of the slats 505 (e.g., only in those slats that are centrally located over the wall opening 101 when the barrier assembly is fully deployed) depending on a desired amount of slat dislodgement reduction or a determination of which slats are more likely to be dislodged when the barrier assembly is fully deployed and displacement forces are applied. Further, the roller 107 that retains the slats 105 of the barrier assembly of FIG. 1 may be spring-loaded instead of motorized to facilitate manual deployment and retraction of the barrier assembly. Accordingly, the specification and drawings are to be regarded in an illustrative rather than a restrictive sense, and all such modifications are intended to be included within the scope of the present invention.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. As used herein and in the appended claims, the terms "comprises," "comprising" or any other variation thereof is intended to refer to a non-exclusive inclusion, such that a process, method, apparatus, or article of manufacture that comprises a list of elements does not include only those elements in the list, but may include other elements not expressly listed or inherent to such process, method, apparatus, or article of manufacture.

I claim:

1. A shutter system for covering an opening in a wall of a building, the shutter system comprising:

a mounting assembly that includes at least one pair of guide tracks, each guide track of the at least one pair being mountable to the building on opposing sides of the opening, each guide track including a plurality of inner surfaces that define a guide channel, two of the inner surfaces opposing one another and at least one of said two, opposing inner surfaces including at least one protruding member that extends into the guide channel and angles away from an open end of the guide channel; and a barrier assembly that includes a plurality of interlocking flexible slats, at least some of the slats defining at least one angled recess constructed to accommodate unobstructed passage of the slats in the guide channel during deployment and retraction of the barrier assembly and further constructed to enable the slats to engage the at least one protruding member of the guide track and thereby retain the slats in the guide channel in the event that the slats are deflected due to exertion of a displacement farce against the barrier assembly.

2. The shutter system of claim 1, wherein each guide track further includes a pair of guide rails extending along a length of the guide track, the guide rails being disposed on the two, opposing inner surfaces of the guide track proximate the open end of the guide channel and extending into the guide channel, wherein at least some of the slats further define at least a second recess constructed to enable the slats to engage at least one of the guide rails to assist in retaining the slats in the guide channel in the event that the slats are deflected due to exertion of the displacement force against the barrier assembly.

3. The shutter system of claim 1, further comprising a motorized roller constructed and arranged to retain the barrier assembly in a rolled configuration until deployment is desired and to deploy the barrier assembly upon activation by a user such that the plurality of slats pass through the at least one pair of guide tracks to cover the opening.

4. The shutter system of claim 1, wherein at least one of the plurality of slats and the at least one pair of guide tracks is fabricated from an aluminum alloy.

5. The shutter system of claim 1, wherein the inner surface from which the at least one protruding member extends and an inner, angled surface of the at least one protruding member form an angle in the range of about 45 degrees to about 75 degrees.

6. A barrier assembly for use in a shutter system that includes at least one pair of guide tracks mounted on opposing sides of an opening in a wall of a building, each guide track including a plurality of inner surfaces that define a guide channel, two of the inner surfaces opposing one another and at least one of said two, opposing inner surfaces including at least one protruding member that extends into the guide channel and angles away from an open end of the guide channel, the barrier assembly comprising:

a plurality of interlocking flexible slats, at least some of the slats defining at least one angled recess constructed to accommodate unobstructed passage of the slats in the guide channel during deployment and retraction of the barrier assembly and further constructed to enable the slats to engage the at least one protruding member of the guide track and thereby retain the slats in the guide channel in the event that the slats are deflected due to exertion of a displacement force against the barrier assembly.

7. The barrier assembly of claim 6, wherein the plurality of slats are fabricated from an aluminum alloy.

8. A baffler assembly for use in a shutter system that includes at least one pair of guide tracks mounted on opposing sides of an opening in a wall of a building, each guide track including a plurality of inner surfaces that define a guide channel, two of the inner surfaces opposing one another and at least one of said two, opposing inner surfaces including at least one protruding member that extends into the guide channel and angles away from an open end of the guide channel, each guide track further including a pair of guide rails extending into the guide channel along a length of the guide track and being disposed on the two, opposing inner surfaces of the guide track proximate the open end of the guide channel, the barrier assembly comprising:

a plurality of interlocking flexible slats, at least some of the slats defining at least one angled recess constructed to accommodate unobstructed passage of the slats in the guide channel during deployment and retraction of the barrier assembly and further constructed to enable the slats to engage the at least one protruding member of the guide track and thereby retain the slats in the guide channel in the event that the slats are deflected due to exertion of a displacement force against the barrier assembly, at least some of the slats further defining at least a second recess constructed to enable the slats to engage at least one of the guide rails to further assist in retaining the slats in the guide channel in the event that the slats are deflected due to exertion of the displacement force against the barrier assembly.

9. The shutter system of claim 1, wherein the at least one angled recess includes a first angled recess positioned between a first horizontal end of a slat and a center of the slat such that the slat includes a first lip between the first angled recess and the first horizontal end of the slat.

10. The shutter system of claim 9, wherein the at least one angled recess further includes a second angled recess positioned between a second horizontal end of the slat and the center of the slat such that the slat includes a second lip between the second angled recess and the second horizontal end of the slat.

11. The shutter system of claim 1, wherein the plurality of interlocking flexible slats span the opening in the wall when the barrier assembly is deployed, each of the plurality of interlocking flexible slats terminating at a first end in a first guide channel of a first guide track of the at least one pair of guide tracks such that the first end of each slat is positioned into the first guide channel beyond the protruding member of the first guide track, and each of the plurality of interlocking flexible slats further terminating at a second end in a second guide channel of a second guide track of the at least one pair of guide tracks such that the second end of each slat is positioned into the second guide channel beyond the protruding member of the second guide track.

12. The barrier assembly of claim 6, wherein the at least one angled recess includes a first angled recess positioned between a first horizontal end of a slat and a center of the slat such that the slat includes a first lip between the first angled recess and the first horizontal end of the slat.

13. The barrier assembly of claim 12, wherein the at least one angled recess further includes a second angled recess positioned between a second horizontal end of the slat and the center of the slat such that the slat includes a second lip between the second angled recess and the second horizontal end of the slat.

14. The barrier assembly of claim 6, wherein the plurality of interlocking flexible slats span the opening in the wall when the barrier assembly is deployed, each of the plurality of interlocking flexible slats terminating at a first end in a first guide channel of a first guide track of the at least one pair of guide tracks such that the first end of each slat is positioned into the first guide channel beyond the protruding member of the first guide track, and each of the plurality of interlocking flexible slats further terminating at a second end in a second guide channel of a second guide track of the at least one pair of guide tracks such that the second end of each slat is positioned into the second guide channel beyond the protruding member of the second guide track.

15. The barrier assembly of claim 8, wherein the at least one angled recess includes a first angled recess positioned between a first horizontal end of a slat and a center of the slat such that the slat includes a first lip between the first angled recess and the first horizontal end of the slat.

16. The barrier assembly of claim 15, wherein the at least one angled recess further includes a second angled recess positioned between a second horizontal end of the slat and the center of the slat such tat the slat includes a second lip between the second angled recess and the second horizontal end of the slat.

17. The barrier assembly of claim 8, wherein the plurality of interlocking flexible slats span the opening in the wall when the barrier assembly is deployed, each of the plurality of interlocking flexible slats terminating at a first end in a first guide channel of a first guide track of the at least one pair of guide tracks such that the first end of each slat is positioned into the first guide channel beyond the protruding member of the first guide track, and each of the plurality of interlocking flexible slats further terminating at a second end in a second guide channel of a second guide track of the at least one pair of guide tracks such that the second end of each slat is positioned into the second guide channel beyond the protruding member of the second guide track.

* * * * *